US009289657B1

(12) United States Patent
Rice

(10) Patent No.: US 9,289,657 B1
(45) Date of Patent: Mar. 22, 2016

(54) FOOTBALL WITH FREE MOVING WEIGHT

(71) Applicant: Chris Rice, Cottonwood, AZ (US)

(72) Inventor: Chris Rice, Cottonwood, AZ (US)

( * ) Notice: Subject to any disclaimer, the term of this patent is extended or adjusted under 35 U.S.C. 154(b) by 0 days.

(21) Appl. No.: 14/313,992

(22) Filed: Jun. 24, 2014

(51) Int. Cl.
*A63B 43/04* (2006.01)

(52) U.S. Cl.
CPC ..... *A63B 43/04* (2013.01)

(58) Field of Classification Search
CPC .. A63B 2041/005; A63B 43/04; A63B 41/00; A63B 2243/007
USPC ..... 473/594, 595, 438; 273/DIG. 20
See application file for complete search history.

(56) References Cited

U.S. PATENT DOCUMENTS

| | | | | | |
|---|---|---|---|---|---|
| 450,759 | A | | 4/1891 | Peterson | |
| 1,873,221 | A | | 8/1932 | Senn | |
| 2,364,247 | A | * | 12/1944 | Shearer | 473/610 |
| 2,524,546 | A | * | 10/1950 | Sinclaire | 473/570 |
| 3,450,407 | A | * | 6/1969 | Russo | 473/438 |
| 3,498,613 | A | | 3/1970 | Dreyer | |
| 3,655,197 | A | * | 4/1972 | Milbaum | A63F 5/04 273/146 |
| 3,942,793 | A | * | 3/1976 | Lombardo | 473/451 |
| 3,995,855 | A | * | 12/1976 | Schultz | 473/594 |
| 4,088,319 | A | | 5/1978 | Clarke | |
| 4,194,737 | A | | 3/1980 | Farmer | |
| 4,756,530 | A | | 7/1988 | Karman | |
| 4,915,669 | A | * | 4/1990 | Russell | 446/221 |
| 4,943,066 | A | | 7/1990 | Lathim et al. | |
| 4,986,540 | A | * | 1/1991 | Leslie | 473/594 |
| 5,000,451 | A | * | 3/1991 | MacDonald et al. | 473/594 |
| 5,219,162 | A | * | 6/1993 | Orbanes et al. | 473/571 |
| 5,224,704 | A | * | 7/1993 | Snell | 473/604 |
| 5,342,043 | A | * | 8/1994 | Baltronis et al. | 473/599 |
| 5,358,448 | A | | 10/1994 | Stephens | |
| 6,056,622 | A | * | 5/2000 | Chung | 446/435 |
| 6,186,095 | B1 | * | 2/2001 | Simon | 119/707 |
| 6,398,616 | B1 | * | 6/2002 | Motosko, III | 446/220 |
| 6,443,863 | B1 | * | 9/2002 | Dinoffer | 473/595 |
| 6,537,125 | B1 | | 3/2003 | Motosko, III | |
| 6,645,098 | B1 | | 11/2003 | Quinn | |
| 6,935,274 | B1 | | 8/2005 | Rothschild | |
| 6,991,561 | B2 | | 1/2006 | Nesbitt et al. | |
| 7,374,469 | B2 | * | 5/2008 | Lin | 446/273 |
| 7,740,551 | B2 | * | 6/2010 | Nurnberg et al. | 473/570 |
| 7,780,555 | B2 | | 8/2010 | Wong et al. | |
| 8,695,979 | B1 | * | 4/2014 | Seldin | A63F 9/0001 273/153 R |
| 2005/0049092 | A1 | | 3/2005 | Lo | |
| 2006/0205544 | A1 | * | 9/2006 | Wyner et al. | 473/569 |
| 2008/0242458 | A1 | | 10/2008 | Winn | |
| 2008/0305899 | A1 | | 12/2008 | Lin | |
| 2009/0286632 | A1 | * | 11/2009 | Laliberty et al. | 473/603 |
| 2010/0261561 | A1 | | 10/2010 | Wang | |
| 2011/0015010 | A1 | | 1/2011 | Forrest, Sr. | |

FOREIGN PATENT DOCUMENTS

| | | | | |
|---|---|---|---|---|
| CN | 101073702 | A | * | 11/2007 |
| FR | 2549732 | A1 | * | 2/1985 |
| JP | 2003102872 | A | * | 4/2003 |
| WO | WO 03020378 | A1 | * | 3/2003 |
| WO | WO 2005044395 | A1 | * | 5/2005 |

* cited by examiner

*Primary Examiner* — Steven Wong
(74) *Attorney, Agent, or Firm* — Booth Udall Fuller, PLC

(57) ABSTRACT

A football with a free moving weight. Implementations may include an outer cover, a bladder within the outer cover, and a free weight within the bladder.

20 Claims, 4 Drawing Sheets

FOOTBALL WITH FREE MOVING WEIGHT

TECHNICAL FIELD

Aspects of this document relate to a football with a free moving weight.

BACKGROUND

In American football for example, there are many ball handlers, including quarter backs, running backs, receivers, and the like. Holding onto, catching, gripping, receiving, and the like a football takes practice. A football is hard to hold on to and must be properly held, but many ball handlers do not have the necessary strength or habits required and often fumble or drop a football when hit or otherwise carrying or running with the football.

SUMMARY

Aspects of this document relate to a football with a moving weight therein. These aspects may comprise, and implementations may include, one or more or all of the components and steps set forth in the appended CLAIMS.

In one aspect, an implementation of a football may include an outer cover, a bladder within the outer cover, and a free weight within the bladder.

Particular implementations may include one or more or all of the following.

The weight may have a curvilinear shape or a rectilinear shape.

The weight may have a plurality of bumps formed on its outer surface. The plurality of bumps may be of a different size.

The weight may have an outer layer overlaid onto its outer surface. The outer layer may be a resilient outer layer.

The weight may be a solid weight that fixes in place a separate inner weight within the solid weight. The inner weight may be centrally located in a fixed position within the solid weight or fixedly positioned off center of the solid weight. The solid weight may be egg shaped and have a greater volume than that of the inner weight, and the inner weight may be located at a bottom-center of the solid weight and be heavier than the solid weight.

The weight may be a hollow weight with a free separate inner weight located therein.

The weight may be suspended in the bladder by an elastic cord.?

The foregoing and other aspects, implementations, features, and advantages will be apparent from the DESCRIPTION and DRAWINGS, and from the CLAIMS.

DRAWINGS

Implementations will hereinafter be described in conjunction with the appended DRAWINGS, where like designations denote like elements.

DESCRIPTION

This document features a football with a moving weight therein. The weight bounces, rolls, and/or moves (depending on the implementation) around freely inside of the bladder changing the center of gravity of the football arbitrarily and making the football behave erratically or unpredictably, thereby making it a useful training tool for ball handlers.

There are many features of football implementations disclosed herein, of which one, a plurality, or all features or steps may be used in any particular implementation. In the following description, reference is made to the accompanying DRAWINGS which form a part hereof, and which show by way of illustration possible implementations. It is to be understood that other implementations may be utilized, and structural, as well as procedural, changes may be made without departing from the scope of this document. As a matter of convenience, various components will be described using exemplary materials, sizes, shapes, dimensions, and the like. However, this document is not limited to the stated examples and other configurations are possible and within the teachings of the present disclosure.

Components/Features

There are a variety of football implementations.

In general, a football may include an outer skin or cover generally having a prolate spheroid shape (a spheroid in which the polar axis is greater than the equatorial diameter) with pointed ends (as used in American football and Canadian football for example) or with more rounded ends (as used in the rugby and Australian football for example). Enclosed by the outer cover is an inflatable elastic hollow bladder, in which is inserted a weight with a curvilinear (e.g., spherical) or rectilinear (e.g. square) shape. The weight is free to bounce, roll, and move (depending on the implementation) around freely inside of the bladder making it a useful training tool for ball handlers.

Figure 1:
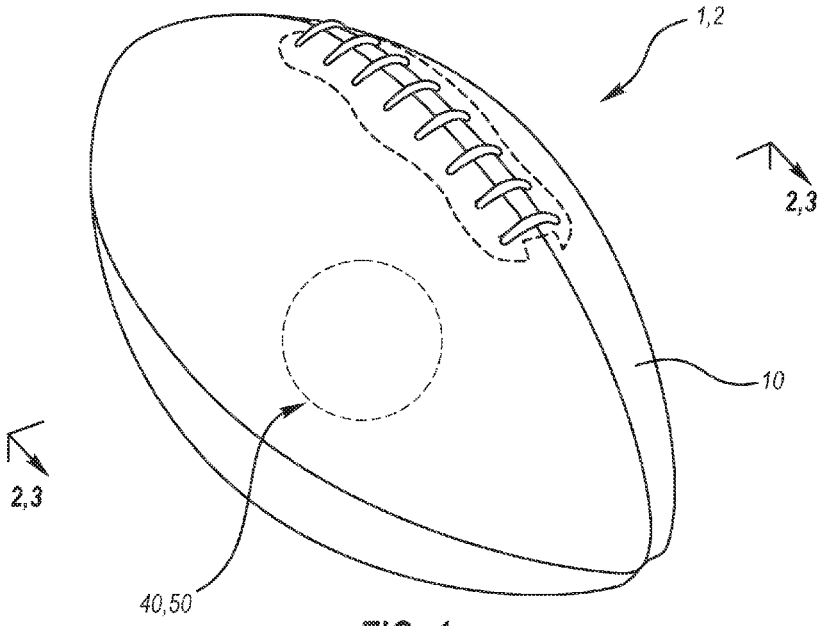
FIG. 1 is a perspective view of a football implementation.
Figure 2:
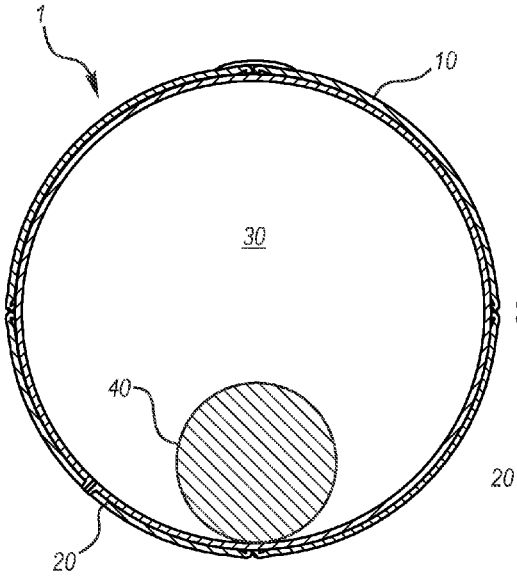
FIGS. 2-3 are cross-sectional views of the football implementation of FIG. 1 taken along line 2,3-2,3.

Notwithstanding, with reference to FIGS. 1-2 and for the exemplary purposes of this disclosure, football 1 is depicted. Football 1 is an American football and includes an outer cover 10 fabricated of a plurality of identical cover sections or panels sewn together along juxtaposed edges generally having a prolate spheroid shape with pointed ends. Enclosed by outer cover 10 is an inflatable elastic hollow bladder 20 defining an interior space 30, in which is inserted a weight 40 with a spherical shape. For example, weight 40 may be a 2 lb to 3 lb round weight. Weight 40 may be heavier or lighter than that though, depending on the application or strength level of the user. Weight 40 provides erratic activity within bladder 20 as it freely bounces, rolls and/or moves around interior space 30.

Additional Implementations

Many additional implementations are possible.

Figure 3:
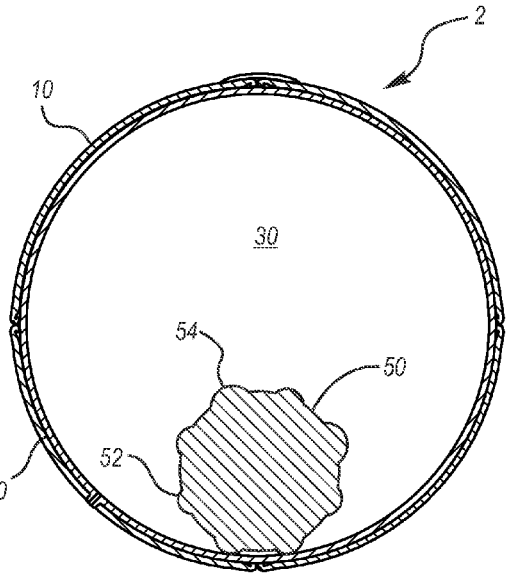

For the exemplary purposes of this disclosure and with reference to FIGS. 1 and 3, football 2 is depicted. Football 2 is similar to football 1 previously described, the principal difference being weight 50. Weight 50 may have a spherical shape (though any other shape is contemplated) and may also include small bumps 52 and large bumps 54 on its outer surface. In other implementations, only bumps 52 or bumps 54 may be included. Weight 50 may be a 2 lb to 3 lb round weight. Weight 50 may be heavier or lighter than that though, depending on the application or strength level of the user. Weight 50 provides erratic activity within bladder 20 as it freely bounces, rolls and/or moves around interior space 30. Bumps 52 and 54 further add to or increase the erratic activity or provide different erratic activity of weight 50.

Figure 4:
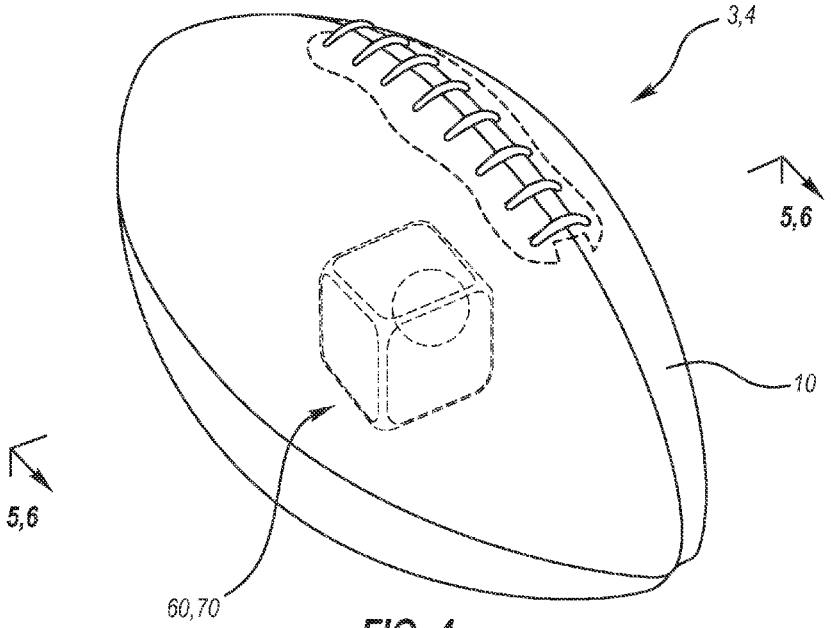
FIG. 4 is a perspective view of another football implementation.
Figure 5:
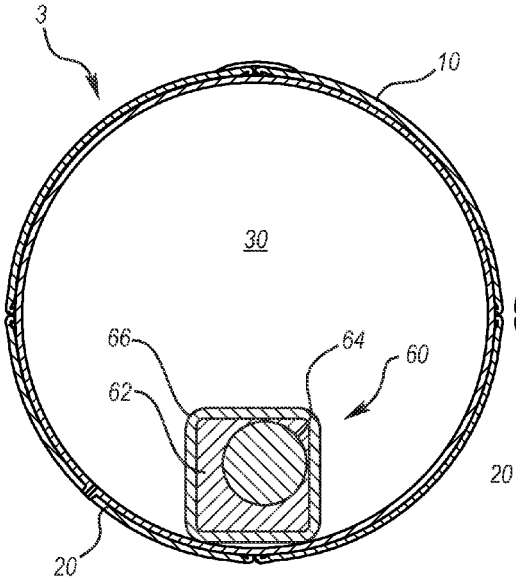
FIGS. 5-6 are cross-sectional views of the football implementation of FIG. 4 taken along line 5,6-5,6.

For the exemplary purposes of this disclosure and with reference to FIGS. 4-5, football 3 is depicted. Football 3 is similar to football 1 previously described, the principal difference being weight system 60. Weight system 60 may have a cubed shape weight 62 (though any other shape is contemplated) with rounded corners and an outer layer 66 overlaid onto its outer surface. Rounded corners and outer layer 66 protect bladder 20 from damage as the weight moves around inside bladder 20. Outer layer 66 may also be highly resilient and may be thick. This would provide an extra "bounce" to weight system 60 as it moves about within bladder 20. Weight system 60 may have a weight of 2 lb to 3 lb. Weight system 60 may be heavier or lighter than that though, depending on the application or strength level of the user. Weight 62 may be a solid weight that fixes in place a separate and inner weight 64 of any shape. While inner weight 64 may be centrally located in a fixed position within weight 62, it may also be fixedly positioned off center of weight 62. Thus, weight system 60 provides erratic activity within bladder 20 as it freely bounces, rolls and/or moves around interior space 30. In other implementations, the rounded corners or the outer layer 66 may not be included. Interior weight 64 further adds to or increases the erratic activity or provides different erratic activity of weight system 60 since it biases the weight system to a certain position.

Figure 9:
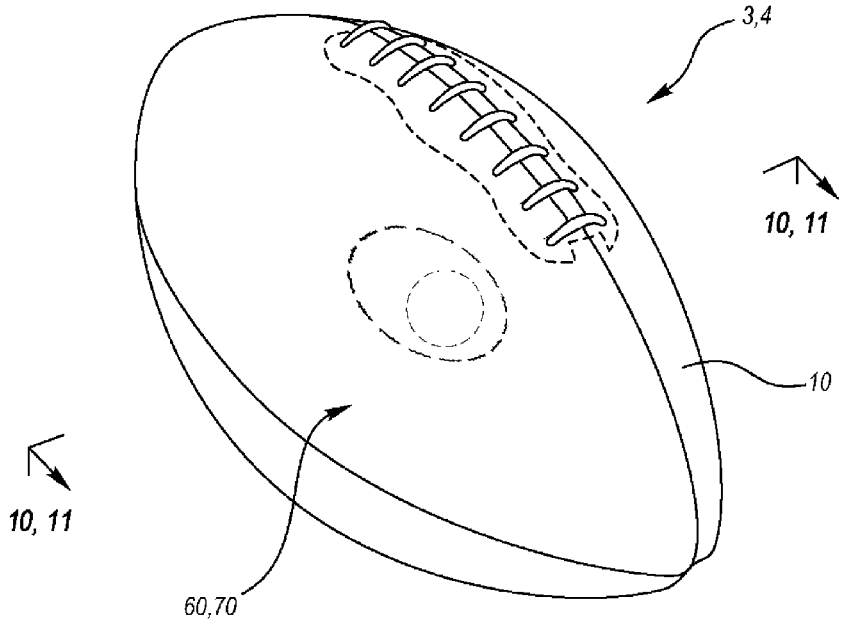
FIG. 9 is a perspective view of another football implementation.
Figure 10:
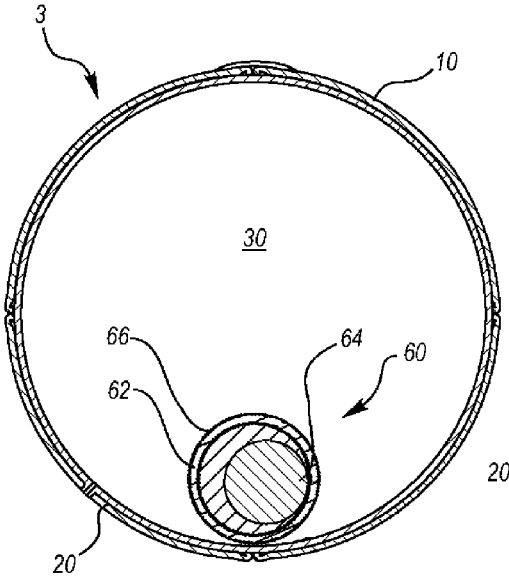
FIGS. 10-11 are cross-sectional views of the football implementation of FIG. 9 taken along line 10,11-10,11.
Figure 11:
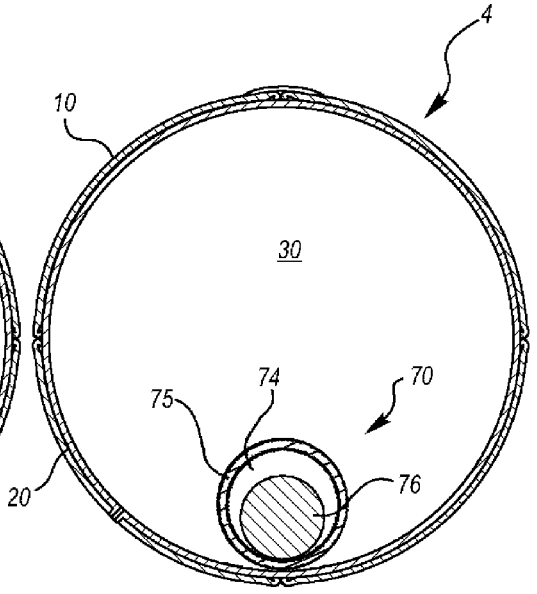

Alternatively, inner weight 64 could be part of a "weeble" or egg shaped outer weight instead of cubed weight 62, for example, as shown in FIGS. 9-11. Such an egg shaped outer weight has a constant positive curvature, a bottom that is a more or less a smooth (unfaceted) hemisphere (to allow the "weeble" to roll), and from the central vertical axis this shape is nearly cylindrically symmetrical (that is, any plane cut through the vertical axis line produces close to the same profile). The volume of the lighter outer weight is greater than that of the heavier inner weight 64. Such a weight system allows for any orientation of the weight system off of the vertical axis line to cause the weight system's centroid to raise and to become offset and provides only one position in which the weight system can achieve stable mechanical equilibrium. Thus, when such an egg-shaped weight system moves around within bladder 20, this causes the inner weight located at the bottom-center to be lifted off the ground. Gravitational force than would always try to bring the egg-shaped weight system back into an upright position.

Figure 6:
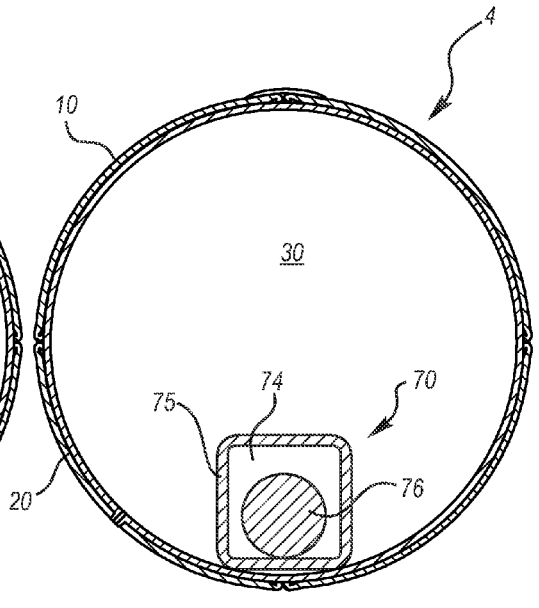

For the exemplary purposes of this disclosure and with reference to FIGS. 4 and 6, football 4 is depicted. Football 4 is similar to football 1 previously described, the principal difference being weight system 70. Weight system 70 may have a cubed shape hollow weight 75 (though any other shape is contemplated) with an interior space 74. Weight 75 may also have rounded corners to protect bladder 20 from damage as the weight moves around inside bladder 20. Weight system 70 may have a weight of 2 lb to 3 lb. Weight system 70 may be heavier or lighter than that though, depending on the application or strength level of the user. Within weight 75 may be a solid, separate and inner weight 76, which may be spherically shaped or any other type of shape in cross-section. Thus, weight system 70 provides erratic activity within bladder 20 as it freely bounces, rolls and/or moves around interior space 30. Interior weight 76 further adds to or increases the erratic activity or provides different erratic activity of weight system 70 since it often acts against weight 75 or keeps weight 75 moving a little longer or provides a secondary movement to weight system 70.

Figure 7:
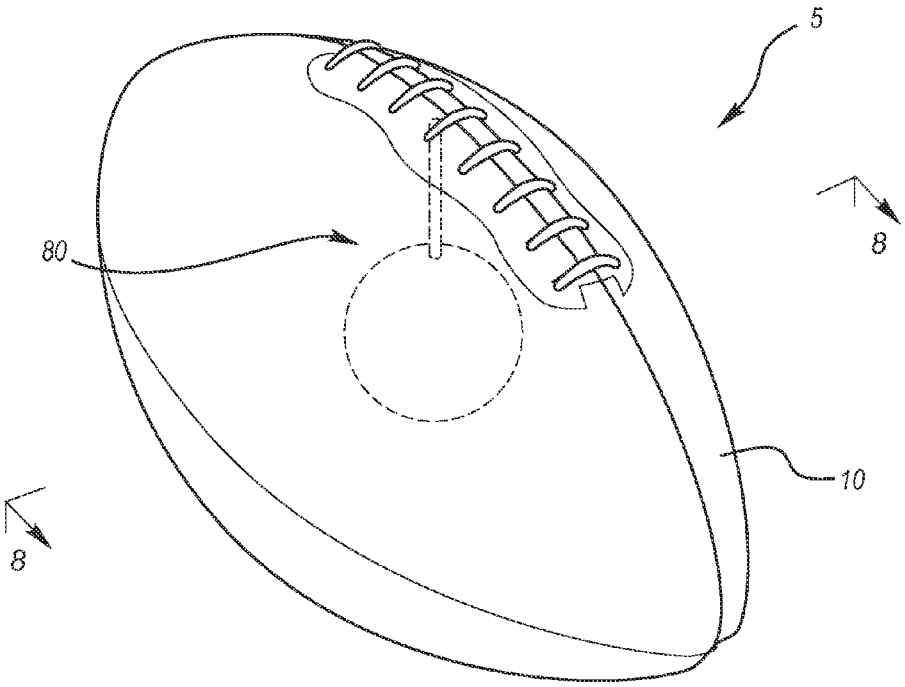
FIG. 7 is a perspective view of still another football implementation.
Figure 8:
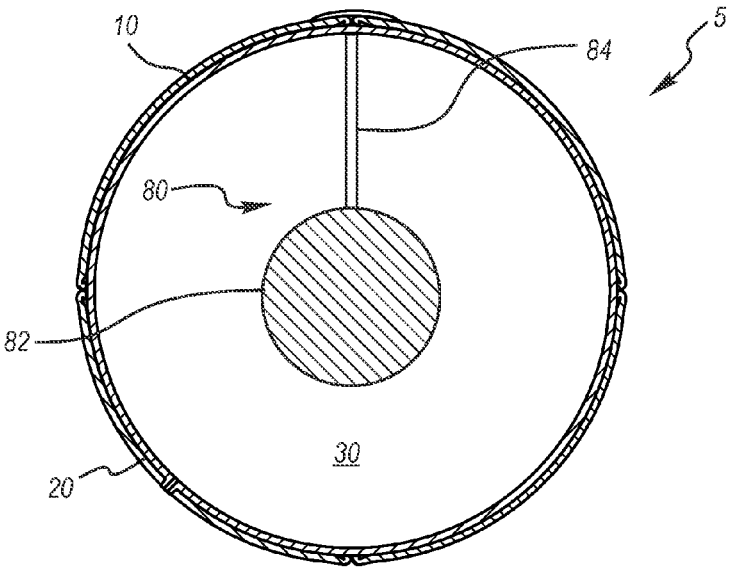
FIG. 8 is a cross-sectional view of the football implementation of FIG. 7 taken along line 8-8.

For the exemplary purposes of this disclosure and with reference to FIGS. 7-8, football 5 is depicted. Football 5 is similar to football 1 previously described, the principal difference being weight system 80. Weight system 80 may have a spherical shaped (though any other shape is contemplated) weight 82. Weight 82 may be a 2 lb to 3 lb round weight. Weight 82 may be heavier or lighter than that though, depending on the application or strength level of the user. Weight 82 may be coupled to bladder 20 and/or outer cover 10 and suspended in interior space 30 by elastic (or bungee or shock) cord 84. Elastic cord 84 may be composed of one or more elastic strands forming a core, usually covered in a woven cotton or polypropylene sheath. The sheath does not materially extend elastically, but it is braided with its strands spiraling around the core so that a longitudinal pull for example causes it to squeeze the core, transmitting the core's elastic compression to the longitudinal extension for example of the sheath and cord. Thus, elastic cord 84 slows the descent or movement in any direction of weight 82 to a stop, before pulling it back. Weight 82 then oscillates up and down or back and forth in any direction until all the energy is dissipated. Thus, weight system 80 provides erratic activity within bladder 20 as weight 82 oscillates back and forth freely in interior space 30 pulling football 5 in different directions.

In other implementations the weight may be heavier or lighter, depending on the application or strength level of the user, and it could even be other curvilinear or rectilinear shapes to provide different types of erratic activity within the bladder as the weight freely bounces, rolls and/or moves around therein. Additionally, the weight or weight system could comprise more than one weight or system, such as two weights or systems, three weights or systems, or even more. Where additional weights or systems are included, some weights could be inside other weights.

In other implementations, any of the components described in this section or elsewhere in this document may be combined together in any combination into any football implementation.

Further implementations are within the CLAIMS.

Specifications Materials Manufacture and Assembly

It will be understood that implementations are not limited to the specific components disclosed herein, as virtually any components consistent with the intended operation of a football may be utilized. Accordingly, for example, although particular components and so forth, are disclosed, such components may comprise any shape, size, style, type, model, version, class, grade, measurement, concentration, material, weight, quantity, and/or the like consistent with the intended operation of a football. Implementations are not limited to uses of any specific components; provided that the components selected are consistent with the intended operation of a football.

Accordingly, the components defining football implementations may be formed of any of many different types of materials or combinations thereof that can readily be formed into shaped objects having a variety of interior and exterior surface textures provided that the components selected are consistent with the intended operation of a football. For example, the components may be formed of: rubbers (synthetic and/or natural) and/or other like materials; leathers (synthetic and/or natural) and/or other like materials; polymers such as thermoplastics (such as ABS, PVC (Polyvinyl chloride), Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; composites and/or other like materials; any other suitable material; and/or any combination thereof.

Various implementations may be manufactured using conventional procedures as added to and improved upon through the procedures described here. Some components may be manufactured simultaneously and integrally joined with one another, while other components may be purchased pre-manufactured or manufactured separately and then assembled with the integral components.

Manufacture of these components separately or simultaneously may involve cutting, sewing, extrusion, pultrusion, vacuum forming, injection molding, blow molding, resin transfer molding, casting, bending, punching, and/or the like. If any of the components are manufactured separately, they may then be coupled with one another in any manner, such as with adhesive, a sonic weld, a fastener, lacing, any combination thereof, and/or the like for example, depending on, among other considerations, the particular material forming the components.

For the exemplary purposes of this disclosure, an American football may be fabricated in the following manner and made in youth and official high school, collegiate, and NFL sizes.

Four cover panels or pieces of leather or plastic for example are provided. Two of the panels are perforated along adjoining edges, so that they can be laced together. Any of the panels (possibly one of the perforated panels) receives a perforation and reinforcements in its center, to hold the inflation valve.

Each panel may then be attached to an interior lining if desired.

The four panels are then stitched together in an "inside-out" manner. The edges with the lacing perforations, however, are not stitched together. The football is then turned right side out by pushing the panels through the lacing hole.

A plastic (e.g. polyurethane) or rubber lining/bladder with a weight therein is then inserted through the hole that will be laced up.

PVC or leather laces (for example) are finally inserted through the lacing perforations to close the hole, thereby providing a grip for holding, hiking and passing the football.

While the assembly of a football implementation has been described in a particular sequence of steps, it will be understood that the assembly of a football implementation is not limited to the specific order of steps as disclosed. Any steps or sequence of steps of the assembly of a football implementation indicated herein are given as examples of possible steps or sequence of steps and not as limitations, since various assembly processes and sequences of steps may be used to assemble a football implementation. Other football implementations may be assembled in a similar manner.

Use

Implementations of a football are particularly useful for American football; especially for training purposes. The weight bounces, rolls, and/or moves around freely inside of the bladder making it a useful training tool for running backs for example and other ball handlers. With the weight, the football is hard to hold on to and must be properly held, thereby creating the proper muscle memory and habits needed to not fumble the football.

However, implementations are not limited to uses relating to American football. Rather, any description relating to American football is for the exemplary purposes of this disclosure, and implementations may also be used in a variety of other football applications (e.g., Canadian football, Association football, Australian rules football, Gaelic football, Rugby football, and the like) or physical therapy applications with similar results.

In places where the description above refers to particular implementations, it should be readily apparent that a number of modifications may be made without departing from the spirit thereof and that these implementations may be alternatively applied. The presently disclosed implementations are, therefore, to be considered in all respects as illustrative and not restrictive. All changes that come within the meaning of and range of equivalency of any part of this disclosure are intended to be embraced therein.

The invention claimed is:

1. A football comprising:

an outer cover;

a bladder within the outer cover; and a free weight within the bladder, the weight comprising a solid weight that fixes in place a separate inner weight within the solid weight, wherein the solid weight is egg shaped and has a greater volume than that of the inner weight, and wherein the inner weight is located at a bottom-center of the solid weight and is heavier than the solid weight.

2. The football of claim 1, wherein the weight has a curvilinear shape or a rectilinear shape.

3. The football of claim 1, wherein the weight has a plurality of bumps formed on its outer surface.

4. The football of claim 3, wherein the plurality of bumps are of a different size.

5. The football of claim 1, wherein the weight has an outer layer overlaid onto its outer surface.

6. The football of claim 1, wherein the outer layer is a resilient outer layer.

7. The football of claim 1, wherein the inner weight is centrally located in a fixed position within the solid weight or fixedly positioned off center of the solid weight.

8. The football of claim 1, wherein the weight comprises a hollow weight with the inner weight being a free separate inner weight located therein.

9. A football comprising:

an outer cover;

a bladder within the outer cover; and a free weight within the bladder, the weight comprising a solid weight that fixes in place a separate inner weight within the solid weight, wherein the inner weight is fixedly positioned off center of the solid weight.

10. The football of claim 9, wherein the weight has a curvilinear shape or a rectilinear shape.

11. The football of claim 9, wherein the weight has a plurality of bumps formed on its outer surface.

12. The football of claim 9, wherein the weight has an outer layer overlaid onto its outer surface.

13. The football of claim 9, wherein the solid weight is egg shaped and has a greater volume than that of the inner weight, and wherein the inner weight is located at a bottom-center of the solid weight and is heavier than the solid weight.

14. The football of claim 9, wherein the weight comprises a hollow weight with the inner weight being a free separate inner weight located therein.

15. A football comprising:

an outer cover;

a bladder within the outer cover; and a weight within the bladder, the weight comprising a solid weight that fixes in place a separate inner weight within the solid weight, wherein the solid weight is egg shaped and has a greater volume than that of the inner weight, and wherein the inner weight is heavier than the solid weight.

16. The football of claim 15, wherein the weight has a curvilinear shape or a rectilinear shape.

17. The football of claim 15, wherein the inner weight is fixedly positioned off center of the solid weight.

18. The football of claim 15, wherein the inner weight is located at a bottom-center of the solid weight.

19. The football of claim 15, wherein the weight comprises a hollow weight with the inner weight being a free separate inner weight located therein.

20. The football of claim 15, wherein the weight is suspended in the bladder by an elastic cord.

* * * * *